US006916079B2

(12) United States Patent
Allen et al.

(10) Patent No.: US 6,916,079 B2
(45) **Date of Patent: *Jul. 12, 2005**

(54) IMAGE FORMING APPARATUS HAVING POSITION SENSING DEVICE

(75) Inventors: William J Allen, Corvallis, OR (US); George C Ross, Philomath, OR (US)

(73) Assignee: Hewlett-Packard Development Company, L.P., Houston, TX (US)

( * ) Notice: Subject to any disclaimer, the term of this patent is extended or adjusted under 35 U.S.C. 154(b) by 6 days.

This patent is subject to a terminal disclaimer.

(21) Appl. No.: 10/654,223

(22) Filed: Sep. 3, 2003

(65) Prior Publication Data

US 2004/0046823 A1 Mar. 11, 2004

Related U.S. Application Data

(63) Continuation of application No. 10/004,434, filed on Oct. 31, 2001, now Pat. No. 6,652,061.

(51) Int. Cl.[7] ..... B41J 29/38
(52) U.S. Cl. ..... 347/16
(58) Field of Search ..... 347/16, 19, 12, 347/14, 23, 10, 11, 37

(56) References Cited

U.S. PATENT DOCUMENTS 5,600,350 A 2/1997 Cobbs et al.
5,798,773 A 8/1998 Hiramatsu et al.
5,992,969 A 11/1999 Terrasa et al.
6,019,454 A 2/2000 Serra et al.
6,206,512 B1 3/2001 Gasso et al.
6,232,594 B1 5/2001 Eccher et al.
6,241,334 B1 6/2001 Haselby
6,247,802 B1 6/2001 Gasso
6,652,061 B2 * 11/2003 Allen et al. ..... 347/19

FOREIGN PATENT DOCUMENTS

WO WO 96/14989 5/1996

OTHER PUBLICATIONS

Patent Abstracts of Japan, vol. 1997, No. 02, Feb. 28, 1997 & JP 08 282048 (Copyer Co Ltd.) Published Oct. 29, 1996; Application Date Apr. 14, 1995.

International Search Report dated Dec. 16, 2002 re International Application No. PCT/US 02/27927 Filed Aug. 28, 2002.

* cited by examiner

*Primary Examiner*—Stephen Meier
*Assistant Examiner*—Charles Stewart, Jr.

(57) ABSTRACT

An image forming apparatus has a movable print device. A sensed device with indicia capable of being sensed is positioned adjacent to the movable print device. At least first and second indicia sensors are carried by the movable print device in spaced relation to one another.

24 Claims, 5 Drawing Sheets

IMAGE FORMING APPARATUS HAVING POSITION SENSING DEVICE

CROSS REFERENCE TO RELATED APPLICATION

This is a continuation of application No. 10/004,434, filed on Oct. 31, 2001 now U.S. Pat. No. 6,652,061, which is hereby incorporated by reference herein.

FIELD OF THE INVENTION

The present inventions are related to an image forming apparatus and, more specifically, to an image forming apparatus having a position sensing device.

BACKGROUND

Image forming apparatus are used to form text and graphic images on a variety of print media including, but not limited to, paper, card stock, mylar and transparency stock. Certain image forming apparatus include a print device that consists of a scanning carriage and one or more printing elements. During an image forming operation, the scanning carriage will traverse back and forth over the surface of the print media along the scan axis. As the scanning carriage traverses back and forth, a controller causes the printing element(s) to print at positions intended to result in portions of the desired image. The print media is periodically advanced along the media axis, which is transverse to that of the movement scanning carriage, so that the image may be completed.

One example of an image forming apparatus with this type of print device is an ink jet printer. Here, one or more ink jet pens are carried by the scanning carriage. The pens often include a printhead with a plurality of ink ejecting nozzles arranged in a two-dimensional array of rows and columns that print individual ink spots (or "drops") as the carriage scans across the media. A 600 dpi (dots-per-inch) printhead with a ½ inch swath will, for example, typically have two columns with 150 nozzles in each column. Ink drops are fired through the nozzles by an ink ejection mechanism, such as a piezo-electric or thermal ejection mechanism, to create the desired dot pattern (or "image").

The ability to accurately track the position of the printing elements as the scanning carriage moves along the scan axis is typically important, regardless of the type of printing element that is carried by the carriage, because position data is used to more accurately control the printing process and reduce dot placement and other printing errors. A linear encoder strip and sensor arrangement are frequently used for this purpose. The encoder strip, which includes a series of graduations, is mounted in parallel with the scan axis and the sensor, such as a light source and detector, is carried by the carriage in close proximity to the encoder strip. Position information from the encoder strip and sensor arrangement is used to control actuation of the printing element and, in the case of an ink jet printer pen, the firing of individual nozzles on the pens. Position information may also be used to control carriage movement.

The accuracy of a conventional encoder strip and senor arrangement decreases as the distance between the sensor and the printing element increases because the relative positions of the printing elements and sensor do not remain constant during a printing operation. This is due to the fact that there is typically some "slop" in the bearings that support the scanning carriage and some flexure of the carriage as it moves along the scan axis. In a multi-printing element image forming apparatus, such as an ink jet printer with a plurality of pens, the distance between some of the printing elements and the sensor can be relatively large, which adversely effects the positional accuracy of those printing elements by increasing the likelihood of dot placement errors. The same problems may be encountered when relatively tall printing elements (i.e. elongated in the media axis) that print relatively tall swaths are used. Here, the distance between the sensor and certain portions of the relatively tall printing element may be large enough to result in erroneous position data for those portions and dot placement or, possibly, other printing errors.

SUMMARY

An apparatus that senses the position of at least two locations on a movable print device may be provided in accordance with one embodiment of a present invention.

BRIEF DESCRIPTION OF THE DRAWINGS

Detailed description of preferred embodiments of the inventions will be made with reference to the accompanying drawings.

DETAILED DESCRIPTION

The following is a detailed description of the best presently known modes of carrying out the inventions. This description is not to be taken in a limiting sense, but is made merely for the purpose of illustrating the general principles of the inventions. Additionally, it is noted that detailed discussions of various internal operating components of image forming apparatus which are not pertinent to the present inventions, such as specific details of the image processing system, print control system, and interaction with a host computer, have been omitted for the sake of simplicity.

Although the present inventions are not limited to any particular image forming apparatus, the exemplary embodiments are described in the context of large format ink jet printers. The inventors herein have determined that one example of a conventional large format printer which could be reconfigured in such a manner that it would embody, incorporate or perform the present inventions is one of the Hewlett Packard DesignJet 2500 Series printers. Impact printers are another example of image forming apparatus to which the present inventions may be applied.

Figure 1:
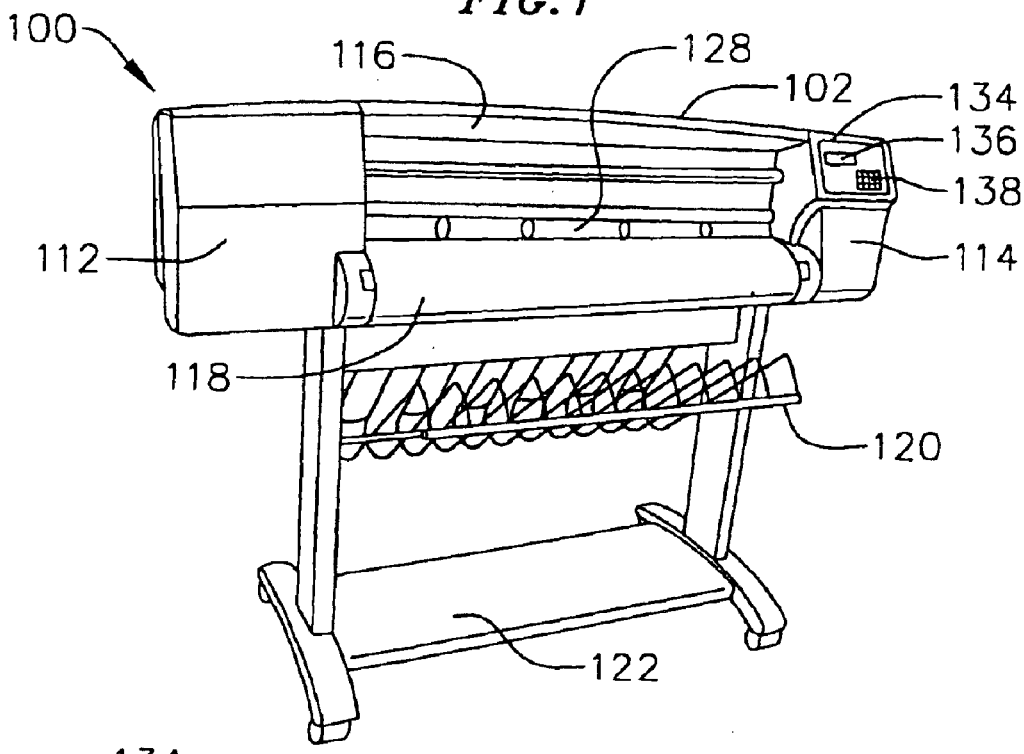
FIG. 1 is a perspective view of an image forming apparatus in accordance with a preferred embodiment of a present invention.
Figure 2:
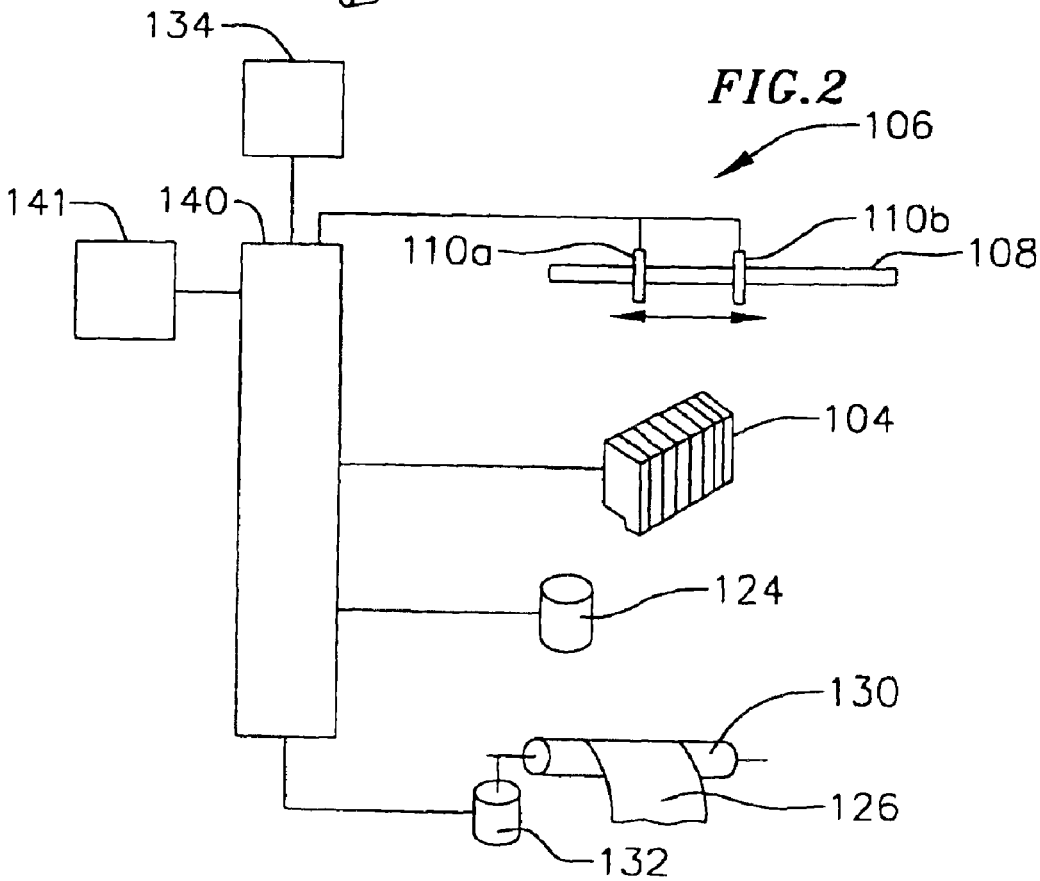
FIG. 2 is a schematic block diagram of the image forming apparatus illustrated in FIG. 1.

As illustrated for example in FIGS. 1 and 2, an image forming apparatus 100 in accordance with one embodiment of a present invention includes a housing 102 and a movable print device 104. The position of the print device 104 is monitored by a sensor system 106 which preferably includes a device having indicia that can be sensed, such as an encoder strip 108 with visible graduations, and at least two sensors 110*a* and 110*b*. The sensor system 106 is discussed in greater detail below. The exemplary housing 102 is provided with end portions 112 and 114, a window 116, a cover 118 that covers a print media roll (not shown), a receiving bin 120 and a shelf 122. The housing end portion 112 preferably encloses a scanning motor 124 that drives print device 104 back and forth over the print media 126 and a plurality of pen refill stations (not shown). The print media 126 is pulled though a slot 128 and carried by a roller 130 that is driven by a motor 132 in conventional fashion. The motor 132 and a printing element cleaning station (not shown) are located within the housing end portion 114. A control panel 134, including a display 136 and control buttons 138, is preferably supported on the exterior of the housing end portion 114.

The print device 104, sensor system 106, motors 124 and 132, and control panel 134 are connected to a printer controller 140 in conventional fashion in the exemplary embodiment. Suitable printer controllers include, for example, microprocessor based controllers. A clock 141 provides time information to the controller 140 which, when combined with position information from the sensor system 106, may be used to calculate the velocity and acceleration of the print device 104, which may in turn be used by the controller as it controls the operation of the print device. Generally speaking, the printer controller 140 receives image data from, for example, an application program, position data from the sensor system 106 and time information from the clock 141 as it controls the operation of the print device 104 and motors 124 and 132 to produce an image that corresponds to the image data. Additional aspects of the operation of the exemplary printer controller 140 are discussed in greater detail below.

Figure 3:
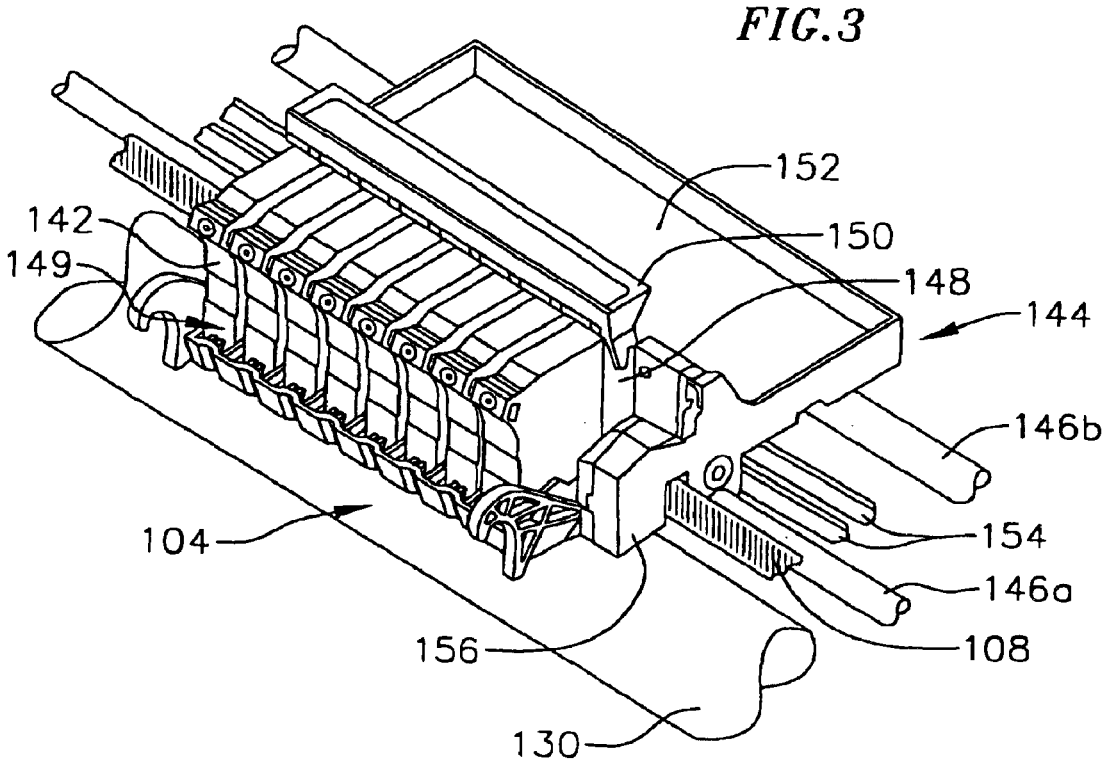
FIG. 3 is a perspective view of a print device in accordance with one embodiment of a present invention.
Figure 4:
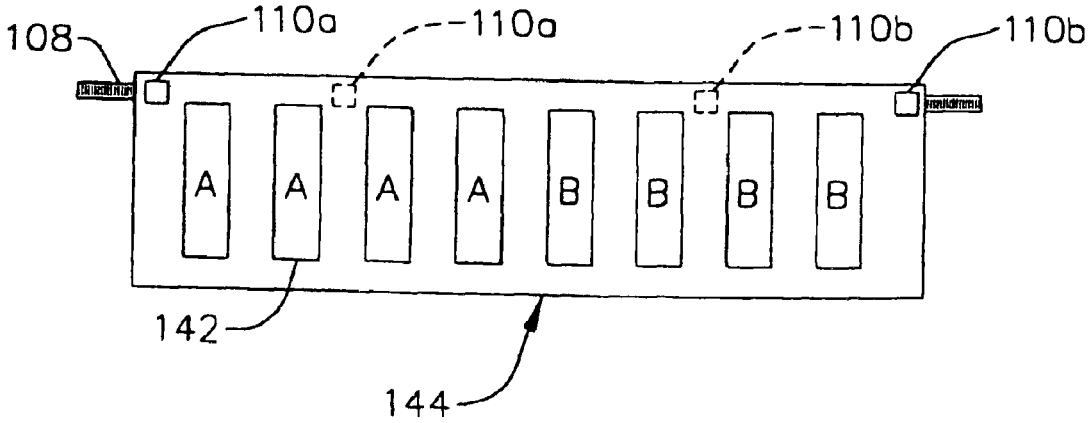
FIG. 4 is a schematic block diagram of a print device and sensor system in accordance with a preferred embodiment of a present invention.

Referring to FIG. 3, the print device 104 in the exemplary image forming apparatus 100 includes a plurality of printing elements. Preferably, the print device 104 is provided with a plurality of ink jet pens 142 (sometimes referred to as "printhead cartridges," "pen cartridges" and "print cartridges") that are carried by a scanning carriage 144 in a formation referred to herein as a "bank." The pens 142 may, for example, be of the readily removable type that include a self-contained ink reservoir, the type that carry a small amount of ink and are refilled by tubes that connect the pens to a remote ink reservoir (in what is sometimes referred to as an "off-axis" system), or the type that are periodically moved to the remote ink reservoirs where they are filled (in what is sometimes referred to as a "take a gulp" system). A suitable pen for use in the exemplary embodiment is the Hewlett Packard Model No. C1806A pen for large format printers such as the aforementioned Hewlett Packard DesignJet 2500 Series printers. Such pens include nozzle plates 143 (FIG. 5) with two columns of 124 nozzles (248 total nozzles).

Although the number of pens 142, the number of pen banks, and the arrangement of the pens within the bank(s) may vary to suit particular applications, the exemplary embodiment illustrated in FIGS. 1–4 includes eight pens in a single bank. The number of pens 142 in a single bank can, however, vary from one to twelve, or even more if applications so require. The banks may be arranged such that each pen is aligned with the other pens (as shown), or such that one or more of the pens in the bank is offset (or "staggered") in the media axis from one or more of the other pens. Additionally, the pens 142 may be arranged such that the nozzle columns are either parallel to the media scan axis or diagonal to the media scan axis.

The exemplary scanning carriage 144, which reciprocatingly slides (or scans) on slide bearings back and forth along slider rods 146*a* and 146*b* (FIG. 3) to define the carriage scan axis, consists primarily of a main body 148 having a plurality of pen slots 149 that respectively receive the pens 142. A pivotable latch 150 may be used to hold the pens 142 in place. A rear tray 152 carries electronic devices such as a pen interface printed circuit board. The electronic devices may also be mounted vertically or in other orientations. The scanning motor 124 is connected to the scanning carriage 144 in the exemplary embodiment by a drive belt 154 in conventional fashion. Other mechanisms for driving a scanning carriage, such as a motor and cable arrangement or linear motor, may be used if desired.

As noted above, and as illustrated for example in FIGS. 2–4, the exemplary image forming apparatus 100 includes a sensor system 106 that consists of a transparent linear encoder strip 108 and a pair of sensors 110*a* and 110*b*. More specifically, the graduations are sensed as the scanning carriage 144 moves to determine the position of the scanning carriage on the scan axis. A suitable sensor is a conventional light source and light sensor arrangement where light from the source is directed through the encoder strip and sensed by the sensor on the other side of the encoder strip. The position data, based on the number of graduations sensed as the scanning carriage 144 moves away from its home location, is used to determine the pen nozzle firing times (i.e. the times at which the nozzles eject ink) during each pass of the scanning carriage 144 over the print media 126. Preferably, the sensors 110*a* and 110*b* are located at the longitudinal ends of the scanning carriage 144 within respective sensor housings 156 (only one visible) and as close to the adjacent pens 142 as practicable. In one embodiment, the data from sensor 110*a* is used to control the nozzle firing times of the four closest pens 142, i.e. those identified with an "A" in FIG. 4, while the data from sensor 110*b* is used to control the nozzle firing times of the other four pens, i.e. those identified with a "B." Position data from either one of the sensors 110*a* and 110*b* may be used in conventional fashion, with time information from the clock 141, for carriage motion control purposes.

In an alternate embodiment, data from the sensors 110*a* and 110*b* is combined and the controller 140 interpolates (and extrapolates, if necessary) positional data for locations between (or beyond) the sensors. Positional data for the location of each pen 142 is interpolated and used to individually control the firing the pens.

Depending on the configuration of the scanning carriage employed and other manufacturing constraints, the sensors 110*a* and 110*b* may be relocated in order to further reduce the distance between the sensors and the associated pens 142 or other printing elements. For example, the sensors 110*a* and 110*b* may be moved to the dash line positions shown in FIG. 4. Additionally, the number of sensors 110*a* and/or

Figure 8:
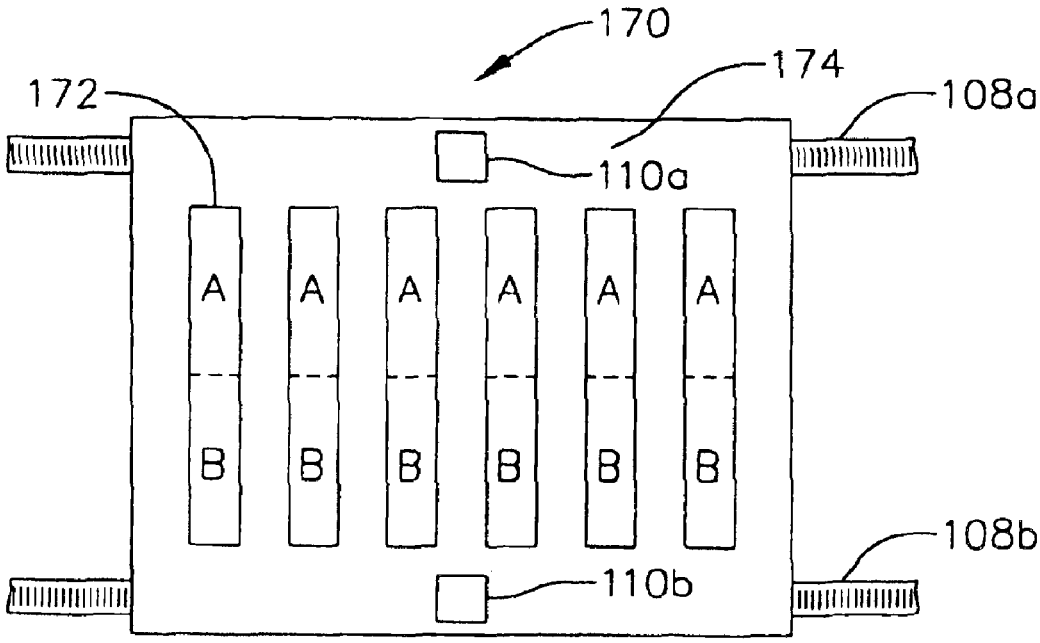
FIG. 8 is a schematic block diagram of a print device and sensor system in accordance with a preferred embodiment of a present invention.

110*b* may also vary depending on the configuration of the associated scanning carriage, the size, number and type of pens (or other printing elements), and the desired level of printing accuracy as measured by, for example, dot placement error. Each pen could even have its own corresponding sensor if an application so required or, as described below with reference to FIG. 8, a single pen could have more than one sensor associated therewith.

Figure 5:
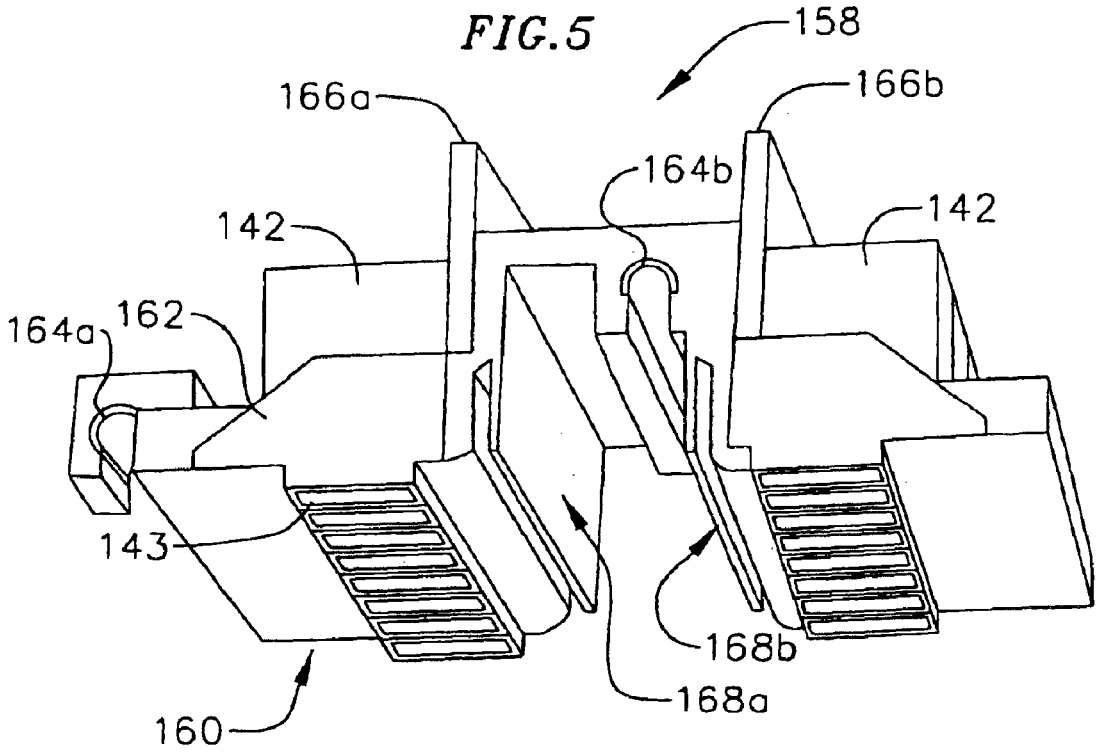
FIG. 5 is a perspective view of a print device in accordance with one embodiment of a present invention.
Figure 6:
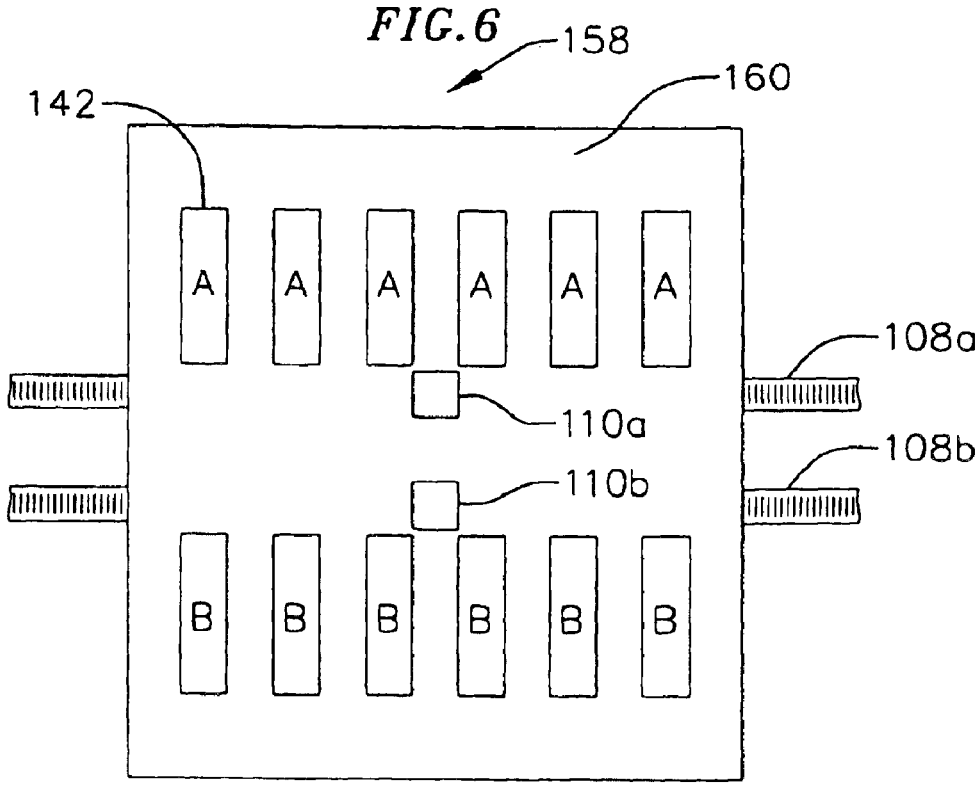
FIG. 6 is a schematic block diagram of a print device and sensor system in accordance with a preferred embodiment of a present invention.

The present inventions are not limited to exemplary image forming apparatus illustrated in FIGS. 1–4. Turning to FIGS. 5 and 6, a print device 158 in accordance with another preferred embodiment includes two banks of pen slots with nozzle plate openings that allow the nozzle plates 143 to face the print media. The print device 158 may be reciprocatingly driven back and forth over print media by a motor and belt arrangement in the manner described above. The pens 142 are supported on a scanning carriage 160 that, in the exemplary embodiment, includes a main body 162 with two banks of six pen slots and a pair of slide bearings 164*a* and 164*b* that allow the carriage to slide along a pair of rails (not shown). Two pen interface printed circuit boards 166*a* and 166*b*, i.e. one for each pen bank, are also provided.

With respect to carriage and, therefore, pen position sensing, the scanning carriage 160 in the exemplary embodiment illustrated in FIGS. 5 and 6 is preferably employed in image forming apparatus including sensor systems having at least two encoder strips 108*a* and 108*b* and at least two sensors 110*a* and 110*b*. To that end, the encoder strips 108*a* and 108*b* pass through a pair of sensor housings 168*a* and 168*b* that are positioned adjacent to the pen banks. The data from sensor 110*a* is used to control the nozzle firing times of the pens 142 identified with an "A" in FIG. 6 and the data from sensor 110*b* is used to control the nozzle firing times of the pens identified with a "B."

Figure 7:
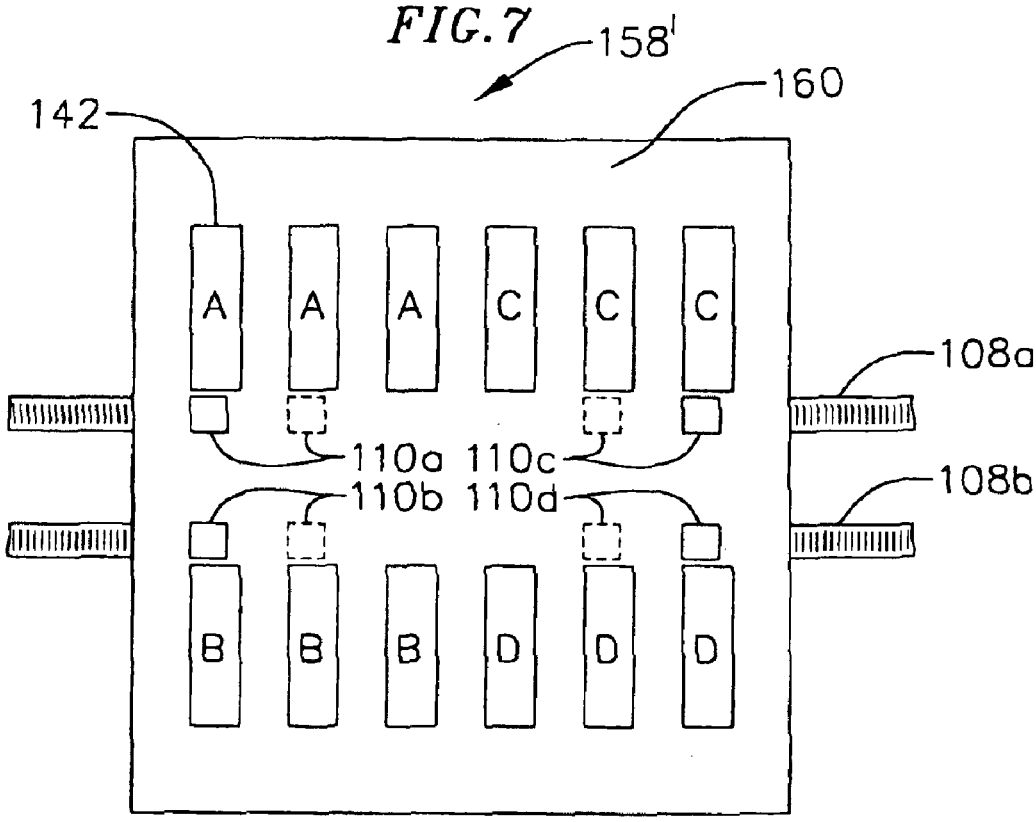
FIG. 7 is a schematic block diagram of a print device and sensor system in accordance with a preferred embodiment of a present invention.

The sensors 110*a* and 110*b* are preferably positioned at the midpoint of each bank of pens 142 in order to minimize the distance between the sensors and the farthest pens therefrom. Alternatively, as illustrated for example in FIG. 7, a print device 158' that is otherwise identical to print device 158 is provided with four sensors 110*a*, 110*b*, 110*c* and 110*d* in order to further increase dot placement accuracy. The data from sensor 110*a* is used to control the nozzle firing times of the pens 142 identified with an "A," the data from sensor 110*b* is used to control the nozzle firing times of the pens identified with a "B," the data from sensor 110*c* is used to control the nozzle firing times of the pens 142 identified with an "C," and the data from sensor 110*d* is used to control the nozzle firing times of the pens identified with a "D." Another alternative, if possible given the scanning carriage configuration and manufacturing constraints, is to position the sensors 110*a*, 110*b*, 110*c* and 110*d* in the positions shown in dash lines in FIG. 7.

The present inventions are also applicable to image forming apparatus in which print devices capable of printing relatively tall swaths are employed. As illustrated for example in FIG. 8, an exemplary print device 170 may include one or more pens 172 or other printing elements on a carriage 174. The pens 172 are relatively tall and print a relatively tall swath (i.e. typically greater than one inch). In order to decrease the distance between the sensor system and the individual nozzles of the relatively tall pens 172, the exemplary print device 170 includes a sensor system consisting of at least two encoder strips 108*a* and 108*b* and at least two sensors 110*a* and 110*b*. The encoder strips 108*a* and 108*b* pass through a pair of sensor housings similar to those discussed above with reference to FIG. 5 and are positioned adjacent to the mid-line of the pen bank. Here, however, the sensors 110*a* and 110*b* are associated with particular nozzles, as opposed to particular pens. More specifically, data from sensor 110*a* is used to control the firing times of the nozzles in the portions of the pens 172 identified with an "A" and data from sensor 110*b* is used to control the firing times of the nozzles in the portions of the pens identified with a "B."

In other implementations of the present inventions, the positions of two or more locations on a movable print device may be monitored using devices other than encoder-based sensor systems. Here, one or more sensor devices are provided within the image forming apparatus and one or more fiducial reference points on the print device facilitate the sensing of position at two different locations on the print device. The fiducial reference points may be additional devices (i.e. "cooperative elements") mounted on the print device or readily identifiable portions of the print device itself such as shiny brackets.

Figure 9:
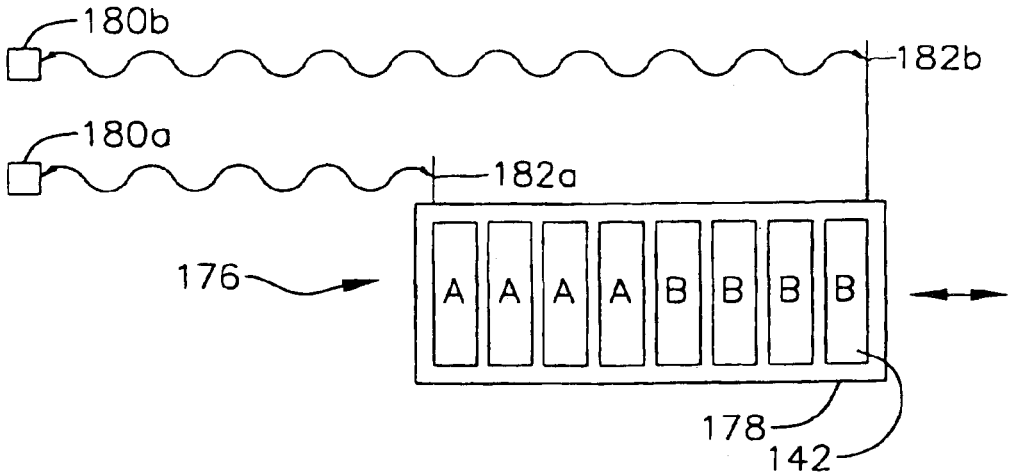
FIG. 9 is a schematic block diagram of a print device and sensor system in accordance with a preferred embodiment of a present invention.

As illustrated for example in FIG. 9, an exemplary print device 176 may include one or more pens 142 or other printing elements on a carriage 178. Movement of the print device 176 is sensed by a laser interferometer system. Here, the laser interferometer system includes a pair of light source and sensor devices 180*a* and 180*b* that are mounted within the associated printing apparatus, preferably at one end of the scan axis, and a pair of reflectors 182*a* and 182*b*, preferably mirrors, that are carried in spaced relation on the carriage 178 and act as the fiducial reference points. The reflectors 182*a* and 182*b* may be located on the top, bottom or sides or the carriage 178. Light beams, including all suitable electromagnetic energy both in and out of the visible spectrum, emitted by the source and sensor devices 180*a* and 180*b* are reflected by the reflectors 182*a* and 182*b* back to the source and sensor devices in the manner illustrated in FIG. 9 to individually determine how far the reflectors have moved from their respective original home locations. Data from sensor 180*a* is used to control the nozzle firing times of the pens 142 identified with an "A" and data from sensor 180*b* is used to control the nozzle firing times of the pens identified with a "B."

Additional source and sensor devices and reflectors may be provided as applications require. Moreover, the individual source and sensor devices 180*a* and 180*b* may be incorporated into a single device capable of providing and sensing more than one light beam and the individual spaced reflectors 182*a* and 182*b* may be incorporated into a single component capable of reflecting light from two different locations on the print device.

Figure 10:
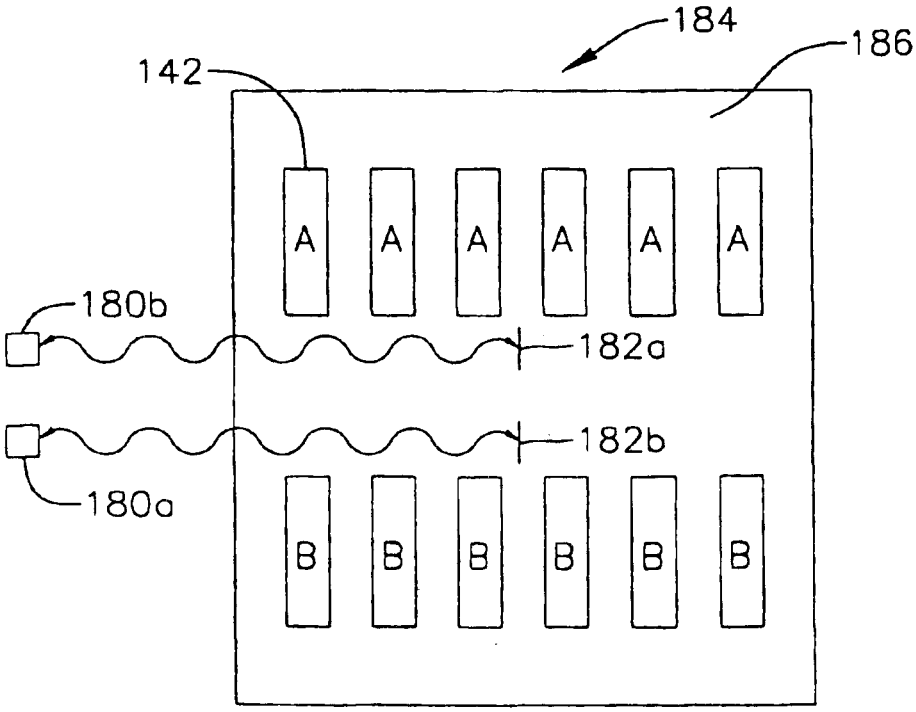
FIG. 10 is a schematic block diagram of a print device and sensor system in accordance with a preferred embodiment of a present invention.

The laser interferometer sensor system described above with reference to FIG. 9 may be incorporated into any of the print devices disclosed herein in place of, or in combination with, other sensor systems. For example, the print device 184 illustrated in FIG. 10 includes a carriage 186 that supports two banks of six pen 142. Here too, a pair of light source and sensor devices 180*a* and 180*b* are mounted within the associated printing apparatus and a pair of reflectors 182*a* and 182*b* are carried in spaced relation on the carriage 186. Data from sensor 180*a* is used to control the nozzle firing times of the pens 142 identified with an "A" and data from sensor 180*b* is used to control the nozzle firing times of the pens identified with a "B."

The present apparatus and methods provide a number of advantages over conventional apparatus and methods. For example, obtaining position data at more than one location on a movable print device reduces the distance between respective portions of the print device and the associated sensor, thereby increasing the accuracy of the print device and reducing the likelihood of dot placement or other errors. Obtaining position data at more than one location on a movable print device also allows print devices that are manufactured with lower tolerances, lower cost materials and/or simplified manufacturing processes to achieve the same dot placement accuracy as those manufactured with tighter tolerances, higher cost materials and/or more complicated manufacturing processes. Additionally, in the event that an individual position sensing subsystem fails, position data from one or more other position sensing subsystems can be used to continue operation, albeit at a reduced level of performance.

Although the present inventions have been described in terms of the preferred embodiments above, numerous modifications and/or additions to the above-described preferred embodiments would be readily apparent to one skilled in the art.

By way of example, but not limitation, relatively tall swaths may be formed using a print device that aligns two or more pens or other printing elements end to end instead of the relatively tall pen described above with reference to FIG. 8. The present inventions are also susceptible to use with a wide variety of sensors in addition to those described above and are not limited to encoder-based and laser interferometer systems. Other suitable sensor systems include photo-reflective encoder strip systems, magnetic encoder strip systems, triangulation sensor systems, magnetostrictive sensor systems, ultrasonic sensor systems, cable extension transducer systems, linear variable differential transformer systems, and digital camera systems. Additionally, sensors and/or fiducial reference points may be carried by some or all of the pens themselves, instead of being carried by the carriage.

It is intended that the scope of the present inventions extend to all such modifications and/or additions.

What is claimed is:

1. An image forming apparatus, comprising:

a movable print device;

a sensed device having indicia that are capable of being sensed positioned adjacent to the movable print device; and at least first and second indicia sensors carried by the movable print device in spaced relation to one another.

2. An image forming apparatus as claimed in claim 1, wherein the movable print device includes at least one ink jet pen having a plurality of nozzles.

3. An image forming apparatus as claimed in claim 1, wherein the movable print device comprises a plurality of printer elements.

4. An image forming apparatus as claimed in claim 1, wherein the movable print device comprises a plurality of printer elements arranged in first and second banks.

5. An image forming apparatus as claimed in claim 1, wherein the sensed device comprises an encoder strip having a plurality of graduations.

6. An image forming apparatus as claimed in claim 1, wherein the sensed device comprises at least first and second sensed devices positioned in spaced relation to one another, the first indicia sensor is in a sensing relationship with the first sensed device, and the second indicia sensor is in a sensing relationship with the second sensed device.

7. An image forming apparatus as claimed in claim 1, wherein at least one of the first and second indicia sensors comprises a light source and a light sensor.

8. An image forming apparatus as claimed in claim 1, further comprising:

a controller, operably connected to the print device and the first and second indicia sensors, that controls a first portion of the print device at least partially in response to data from the first indicia sensor and controls a second portion of the print device at least partially in response to data from second indicia sensor.

9. An image forming apparatus as claimed in claim 8, wherein the print device includes at least first and second printer elements and the controller controls the first printer element at least partially in response to data from the first indicia sensor and controls the second printer element at least partially in response to data from the second indicia sensor.

10. An image forming apparatus as claimed in claim 8, wherein the print device includes a printer element defining first and second longitudinal ends and the controller controls a portion of the printer element adjacent to the first longitudinal end at least partially in response to data from the first indicia sensor and controls a portion of the printer element adjacent to the second longitudinal end at least partially in response to data from the second indicia sensor.

11. The image forming apparatus of claim 1, wherein the indicia comprise first and second indicia and the first and second indicia sensors independently and concurrently sense the first and second indicia, respectively.

12. A scanning carriage for use in an image forming apparatus, the image forming apparatus including at least one sensed device having indicia that are capable of being sensed, the scanning carriage comprising:

a main body configured to at least one printer element; and at least first and second indicia sensors carried by the main body in spaced relation to one another.

13. A scanning carriage as claimed in claim 12, wherein the main body is configured to carry a bank of printer elements, the main body defines first and second longitudinal ends, and the first and second indicia sensors are respectively located near the first and second longitudinal ends of the main body.

14. A scanning carriage as claimed in claim 12, wherein the main body is configured to carry first and second banks of printer elements, the first indicia sensor is closer to the first bank, and the second indicia sensor is closer to the second bank.

15. A scanning carriage as claimed in claim 14, wherein the first and second banks define respective longitudinal ends, the first indicia sensor is located between the longitudinal ends of the first bank, and the second indicia sensor is located between the longitudinal ends of the second bank.

16. A scanning carriage as claimed in claim 12, wherein the at least one printer element defines first and second longitudinal ends, the first indicia sensor is positioned adjacent to the first longitudinal end, and the second position sensor is positioned adjacent the second longitudinal end.

17. A scanning carriage as claimed in claim 16, wherein the main body is configured to carry a plurality of elements.

18. An image forming apparatus, comprising:

a movable print device; and a position sensing device independently sensing a position of at least first and second predetermined locations on the movable print device.

19. An image forming apparatus as claimed in claim 18, wherein the movable print device includes at least one ink jet pen having a plurality of nozzles.

20. An image forming apparatus as claimed in claim 18, wherein the movable print device comprises a plurality of printer elements.

21. An image forming apparatus as claimed in claim 18, wherein the movable print device comprises a plurality of printer elements.

22. An image forming apparatus as claimed in claim 18, further comprising:

a controller, operably connected to the print device and position sensing device, that controls a first portion of the print device at least partially in response to the position of the first location on the print device and controls a second portion of the print device at least partially in response to the position of the second location on the print device.

23. An image forming apparatus as claimed in claim 22, wherein the print device includes at least first and second printer elements and the controller controls the first printer element at least partially in response to the position of the first location on the print device and controls the second printer element at least partially in response to the position of the second location on the print device.

24. An image forming-apparatus as claimed in claim 22, wherein the print device includes a printer element defining first and second longitudinal ends and the controller controls a portion of the printer element adjacent to the first longitudinal end at least partially in response to the position of the first location on the print device and controls a portion of the printer element adjacent to the second longitudinal end at least partially in response to the position of the second location on the print device.

* * * * *

UNITED STATES PATENT AND TRADEMARK OFFICE

CERTIFICATE OF CORRECTION

PATENT NO. : 6,916,079 B2
APPLICATION NO. : 10/654223
DATED : July 12, 2005
INVENTOR(S) : Allen et al.

It is certified that error appears in the above-identified patent and that said Letters Patent is hereby corrected as shown below:

In column 9, line 3, in Claim 21, after "elements"
insert -- arranged in first and second banks --.

In column 10, line 5, in Claim 24, delete "forming-apparatus" and
insert -- forming apparatus --, therefor.

Signed and Sealed this

Twenty-seventh Day of October, 2009

David J. Kappos

David J. Kappos
*Director of the United States Patent and Trademark Office*